US006971497B2

(12) United States Patent
Illedits et al.

(10) Patent No.: US 6,971,497 B2
(45) Date of Patent: Dec. 6, 2005

(54) HANDRAIL-DRIVE FOR AN ESCALATOR OR A MOVING WALK

(75) Inventors: Thomas Illedits, Neufeld (AT); Hubert Hölzl, Reisenberg (AT)

(73) Assignee: Inventio AG, Hergiswil (CH)

( * ) Notice: Subject to any disclaimer, the term of this patent is extended or adjusted under 35 U.S.C. 154(b) by 17 days.

(21) Appl. No.: 10/817,524

(22) Filed: Apr. 1, 2004

(65) Prior Publication Data

US 2004/0222063 A1 Nov. 11, 2004

(30) Foreign Application Priority Data

Apr. 4, 2003 (EP) ..... 03405226

(51) Int. Cl.[7] ..... B66B 23/02
(52) U.S. Cl. ..... 198/330; 198/331
(58) Field of Search ..... 198/330, 331

(56) References Cited

U.S. PATENT DOCUMENTS

| | | | | |
|---|---|---|---|---|
| 4,895,240 | A * | 1/1990 | Bruehl et al. | 198/331 |
| 5,341,909 | A | 8/1994 | Ahls et al. | |
| 6,199,678 | B1 | 3/2001 | Reo | |
| 6,450,317 | B1 * | 9/2002 | Fargo et al. | 198/330 |
| 6,685,004 | B2 * | 2/2004 | Fargo et al. | 198/330 |

FOREIGN PATENT DOCUMENTS

| | | |
|---|---|---|
| CH | 404 916 | 12/1965 |

* cited by examiner

*Primary Examiner*—James R. Bidwell
(74) *Attorney, Agent, or Firm*—Schweitzer Cornman Gross & Bondell LLP

(57) ABSTRACT

A handrail-drive for an escalator or moving walk drives the handrail through frictional contact with an outside surface of the handrail. Press-on rollers engaging the inside of the handrail may be employed to press the handrail against a drive-wheel of the drive. The force of the rollers may be adjustable. The drive-wheel may include a gas-filled tire on a rim and can be driven by a motor, a step-chain wheel, or a step-chain drive.

5 Claims, 4 Drawing Sheets

HANDRAIL-DRIVE FOR AN ESCALATOR OR A MOVING WALK

The present invention relates to an escalator or a moving walk comprising a truss, a step-band with steps or a pallet-band with pallets for the transportation of persons and/or objects, and on each side a balustrade which is held by a balustrade base and has a handrail, the handrail being driven by a handrail-drive.

BACKGROUND OF THE INVENTION

From patent specification EP 640 553 A2 a linear handrail-drive for an escalator has become known. Two drive-wheels with frictional engagement on the inside of the handrail move the handrail, there being provided on the outside of the handrail for each drive-wheel a follower-wheel which presses the handrail against the drive-wheel.

A disadvantage of the known device is that the follower-wheel must exert a high pressing force so that no slip can occur between the handrail and the drive-wheel. The high flexing work shortens the service life of the drive-wheels and of the follower-wheels.

BRIEF DESCRIPTION OF THE INVENTION

It is a purpose of the present invention to provide a handrail-drive that overcomes the shortcomings of the prior art, and provides a drive that can operate with reduced force applied to the handrail and with a greater contact area and reduced friction. Such and other objectives are accomplished by a handrail-drive that engages an outside of the handrail. The drive may include a drive-wheel for frictional engagement with the handrail outside, as well as a press-on roller engaging an inside of the handrail to press the handrail against the drive-wheel.

The advantages achieved by the handrail-drive according to the invention include that the pressure with which the drive-wheel tire and follower-wheel press onto the handrail can be reduced. Because of a greater contact surface of the drive-wheel, more power can be transmitted to the handrail. Due to the springing properties of the drive-wheel tire and the greater contact surface that results therefrom, the handrail is deformed only slightly or insignificantly. A further advantage is that the service life of the drive-wheels, the follower-wheels, and the handrail is increased. Also, dust and/or particles of dirt are prevented from being pressed into the casing of the handrail and/or into the outside of the handrail. The formation of grooves, cracks, or pressure points in the handrail can be avoided with the handrail-drive according to the invention. Roller damage due to flexing work is eliminated because the flexing work is largely absorbed by the filling material, for example, compressed air or inert gases, of the drive-wheel tire.

BRIEF DESCRIPTION OF THE DRAWINGS

The present invention is explained in more detail in the following description of a preferred but, nonetheless, illustrative embodiment thereof, in association with reference to the attached figures, wherein.

DETAILED DESCRIPTION OF THE INVENTION

The handrail-drive according to the invention can also be used on moving walks with pallets. In the rest of the description as follows, only the term "escalator" will be used, but the statements made also apply analogously for a moving walk. As used herein, an "escalator" is construed to also encompass a moving walk, while the terms "step-band" and "steps" are to encompass a pallet band and pallets, respectively, in a moving walk construction.

Figure 1:
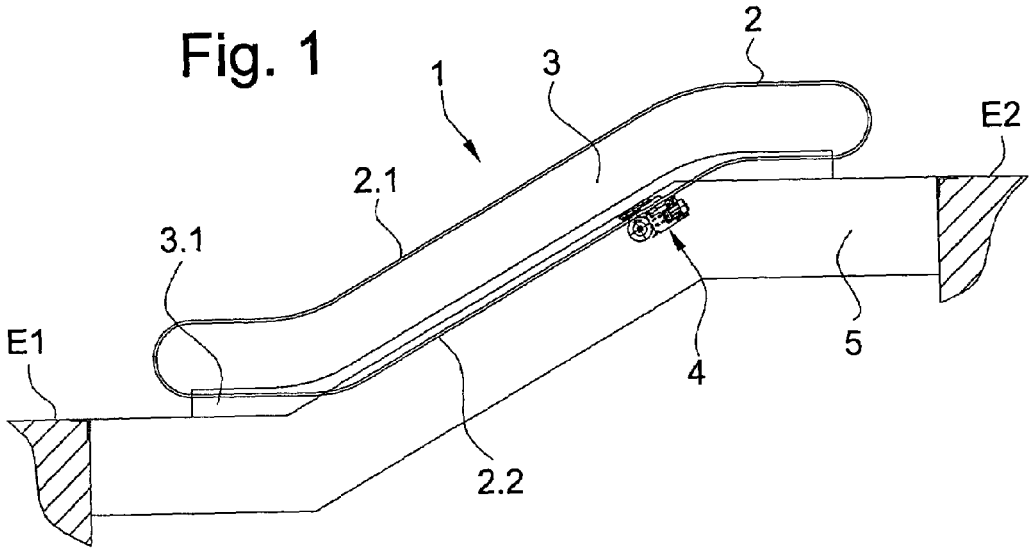
FIG. 1 is a side view of an escalator with a handrail-drive in accordance with the invention.

FIG. 1 shows a side view of an escalator 1 which connects a first landing E1 with a second landing E2. The escalator 1 has a step-band comprising steps. A handrail 2 with a riding-side 2.1 and a return-side 2.2 is arranged on a balustrade 3, which is held at the lower end by means of a balustrade base 3.1. The balustrade base 3.1 is supported by a truss 5 of the escalator 1. A handrail-drive 4 arranged on the truss 5 drives the handrail 2. Arranged at both the upper and the lower end-area of the escalator 1 is a combplate, which ensures safe transition from the stationary section to the moving step-band and from the moving step-band to the stationary section of the escalator 1.

Figure 1A:
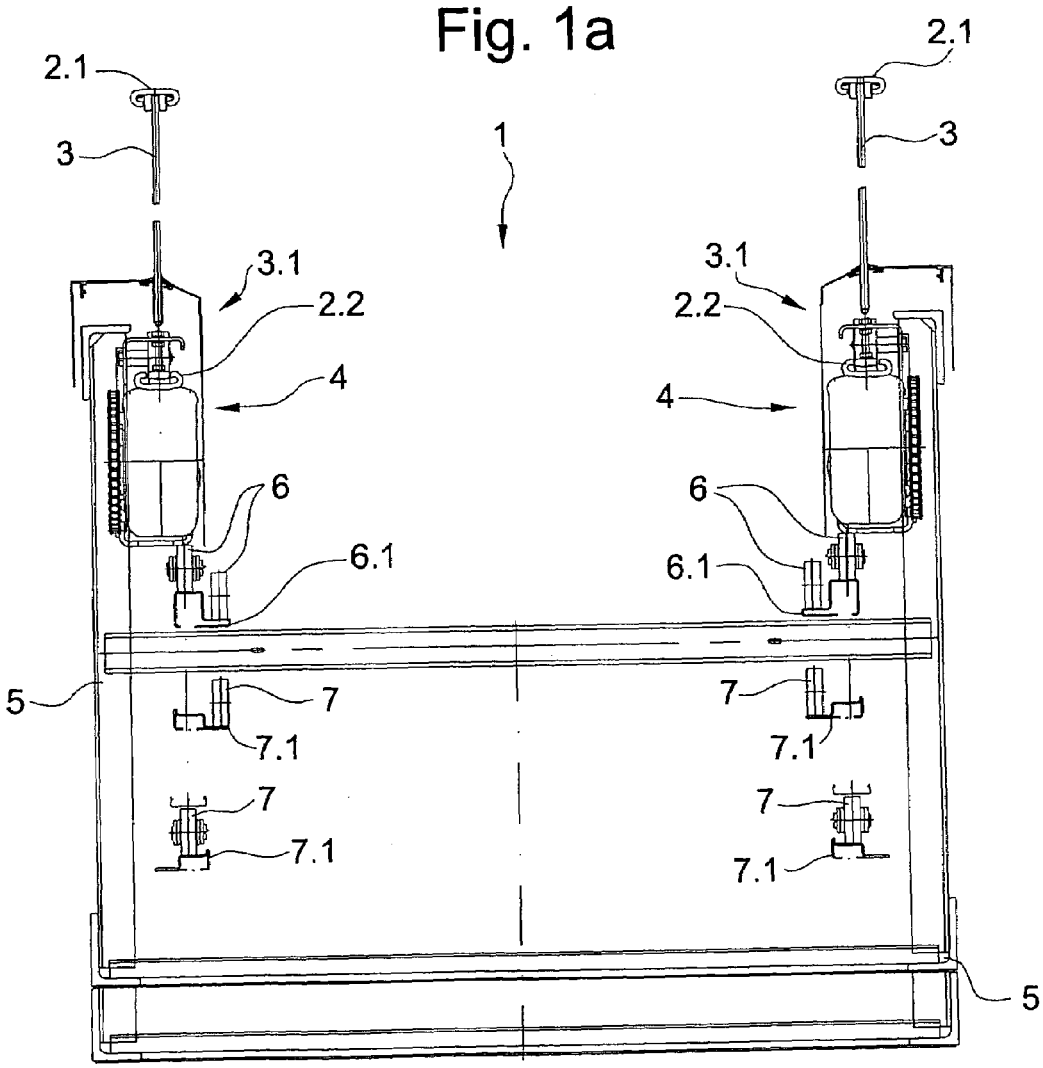
FIG. 1*a* is a cross-section elevation view of the escalator.
Figure 1B:
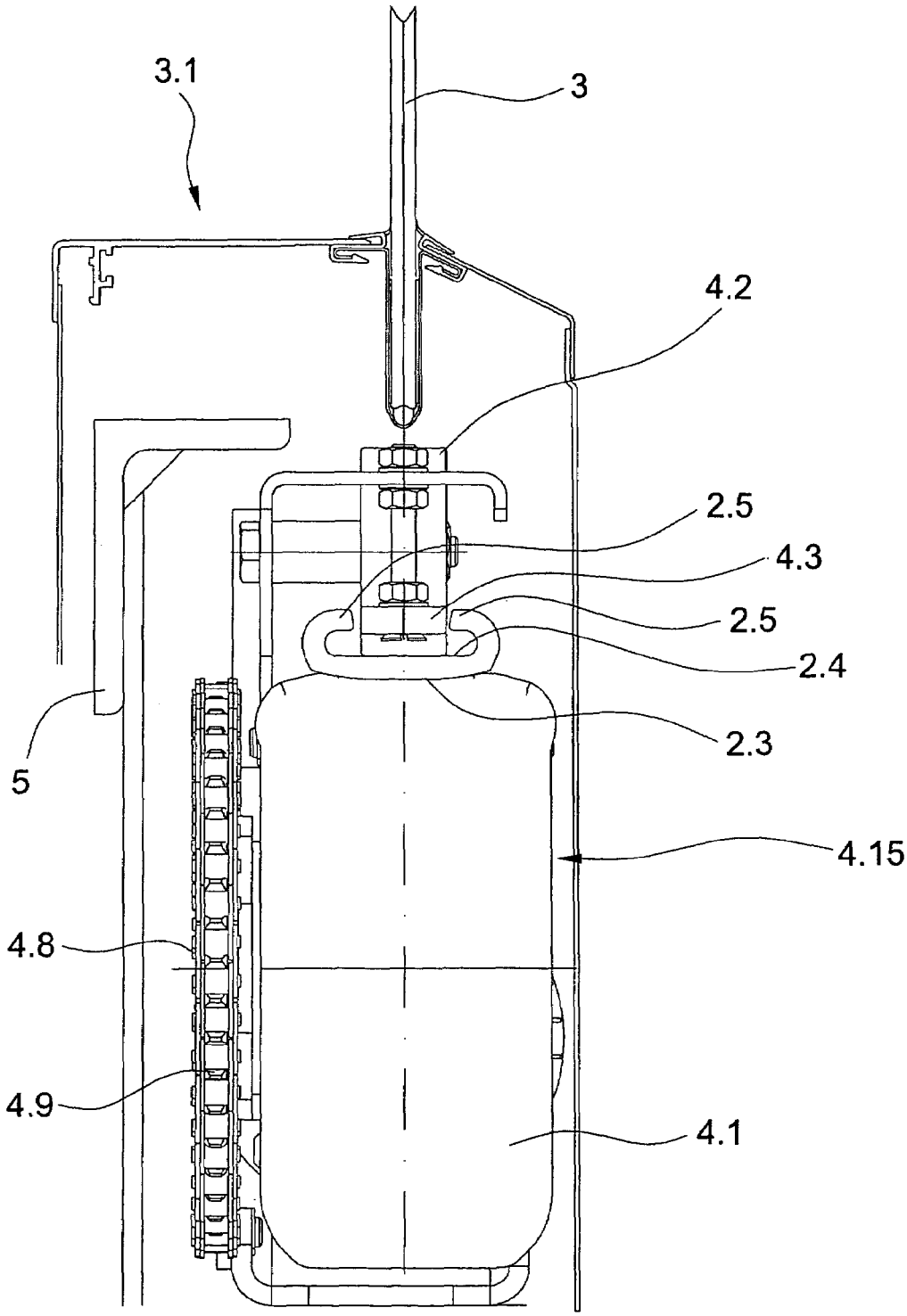
FIG. 1*b* is a cross-section elevation view of a portion of the escalator base with the handrail-drive according to the invention.

FIG. 1*a* shows a cross-section and FIG. 1*b* shows a detail of the escalator 1 with the handrail-drive 4 arranged in the balustrade base 3.1 which drives the handrail 2 on the return-side 2.2. 6 designates step-rollers of the step-band riding-side and 7 designates step-rollers of the step-band return-side, the step-rollers 6 being guided by guides 6.1 and the step-rollers 7 by means of guides 7.1. A drive-wheel tire 4.1 of the handrail-drive 4 is frictionally engaged with the outside 2.3 of the handrail-casing of the handrail 2. Press-on rollers 4.2 press the handrail 2 on its inside or gliding surface 2.4 against the drive-wheel tire 4.1, there being provided for each press-on roller 4.2 an associated handrail guide 4.3 which guides the handrail 2 on the edge or handrail lip 2.5.

Figure 2:
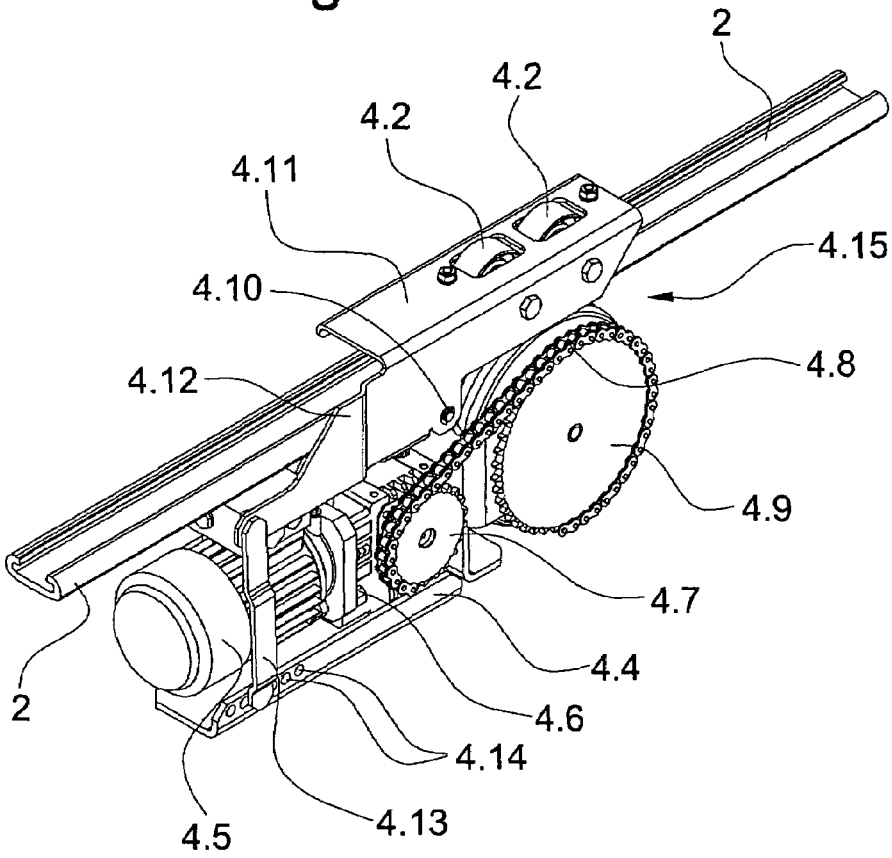
FIG. 2 is a perspective representation of the handrail-drive according to the invention seen from the drive side.
Figure 3:
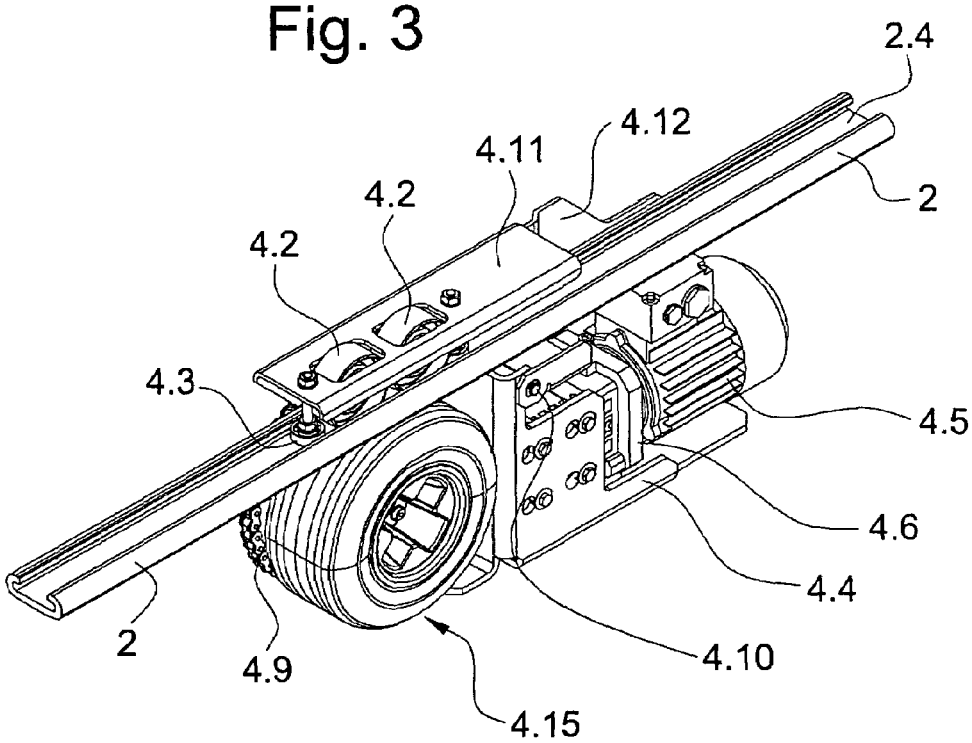
FIG. 3 is a perspective representation of the handrail-drive according to the invention seen from the drive-wheel side.

FIG. 2 shows the handrail-drive 4 from the drive side and FIG. 3 shows the handrail-drive 4 from the drive-wheel side. Arranged on a support 4.4 which is connected to the truss 5 is an electric motor 4.5 and a gearbox 4.6, a gearbox chain-wheel 4.7 being connected by means of a chain 4.8 to a drive-wheel chain-wheel 4.9. Instead of the chain-wheel and chain, a belt (such as a toothed belt or V-belt) and belt-wheels can also be provided. The drive-wheel chain-wheel 4.9 can also be driven by the step-band drive which imparts motion to the steps. Arranged on the support 4.4 is an axle 4.10, on which a rocker 4.11 with an arm 4.12 is pivoted. The rocker 4.11 serves as support for the press-on rollers 4.2 and as support for the handrail guides 4.3. A bracket 4.13 connects the arm 4.12 with the support 4.4, the bracket 4.13 engaging in one of the drilled holes 4.14 arranged in the support 4.4. Depending on the choice of drilled hole, the press-on rollers 4.2 are pressed more or less against the inside of the handrail 2.

Figure 4:
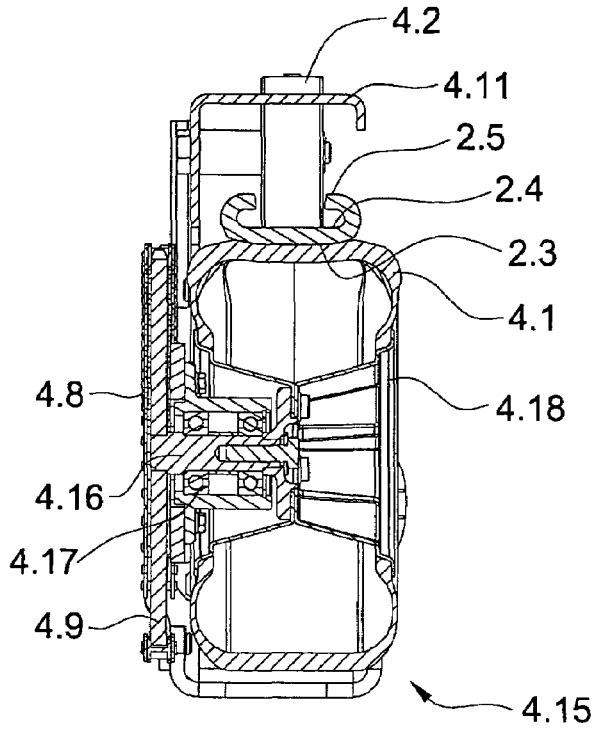
FIG. 4 is a cross-section elevation view taken through the axis of the drive-wheel.

As shown in FIG. 4, the drive-wheel chain-wheel 4.9 is connected by an axle 4.16 to a drive-wheel 4.15 which carries the drive-wheel tires 4.1, the axle 4.16 being held rotatably by a bearing 4.17. The drive-wheel tire 4.1 which is filled with a gas, for example, compressed air, is installed over a dismountable wheel-rim 4.18 which is arranged on the axle 4.16. As shown in FIG. 1*b* and FIG. 4, thanks to its spring properties and/or air-cushion properties, the drive-wheel tire 4.1 adapts to the form of the handrail 2. A solid tire as drive-wheel tire 4.1 is also conceivable.

Figure 5:
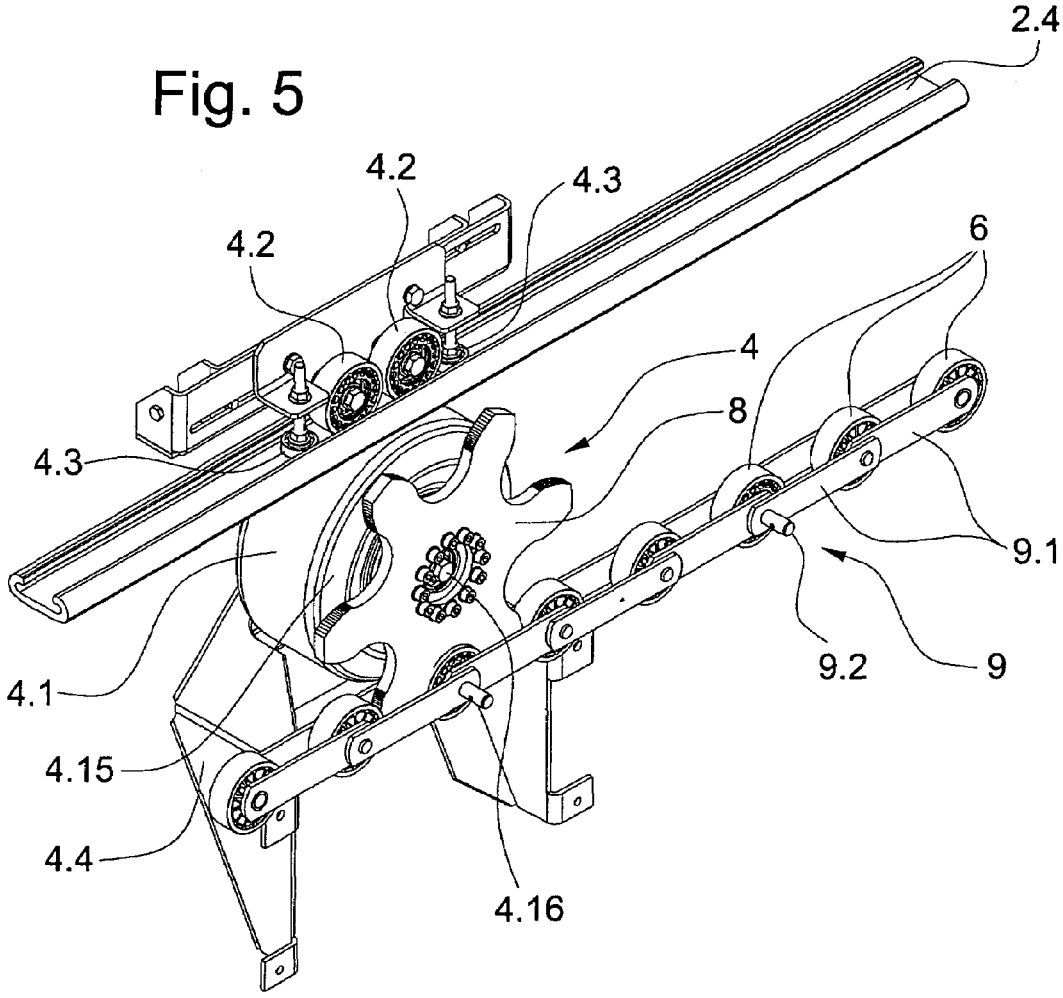
FIG. 5 is a perspective view of a variant embodiment of the handrail-drive.

FIG. 5 shows an alternative exemplary embodiment of the handrail-drive 4. A step sprocket 8 is provided as a drive for the drive-wheel 4.15 instead of the electric motor 4.5 and gearbox 4.6, the step sprocket 8 being arranged on the axle 4.16 and engaged with the step-chain 9. The step-chain 9 driven by the step-chain drive comprises chain-links 9.1, step-rollers 6 and step-axles 9.2 on which the escalator steps are arranged.

Advantageous in this variant are the simple construction and a simple installation. Electric motor 4.5, gearbox 4.6, chain-wheels 4.7, 4.9, and chain 4.8 are dispensed with. Moreover, synchronization is assured by the step-chain 9 which moves the handrail 2 along with it at the same speed.

We claim:

1. An escalator comprising a truss, a step-band with steps for the transportation of persons and/or objects, a balustrade on each side of the step-band held by a balustrade base, a handrail mounted on at least one of the balustrades, and a handrail-drive driving the handrail, characterized in that the handrail-drive drive includes a single axle-driven drive wheel for engaging and driving the handrail on an outside of the handrail and press-on roller means engaging the handrail on an inside of the handrail at a location substantially aligned with a location of engagement of the drive wheel and the handrail inside.

2. The escalator according to claim 1, further characterized in that the drive-wheel has a drive-wheel tire with a peripheral surface that adapts to the form of the handrail outside.

3. The escalator according to claim 2, further characterized in that the drive-wheel tire is arranged on a wheel-rim which is connected to a driving axle.

4. The escalator according to claim 2 or 3, further characterized in that the drive-wheel includes means for driving the drive wheel by one of a group consisting of a motor, a step chain-wheel, and a step chain-wheel drive.

5. The escalator according to claim 2 or 3, further characterized in that the press-on roller means is arranged on a rocker, a pressing force of the press-on roller means being adjustable by a setting of the rocker.

* * * * *